US011015268B2

(12) United States Patent
Sick et al.

(10) Patent No.: US 11,015,268 B2
(45) Date of Patent: May 25, 2021

(54) ARTIFICIAL TURF FIBER WITH LLDPE AND LDPE

(71) Applicant: Polytex Sportbelage Produktions-GmbH, Grefrath (DE)

(72) Inventors: Stephan Sick, Willich (DE); Dirk Sander, Kerken (DE); Bernd Jansen, Nettetal (DE)

(73) Assignee: Polytex Sportbelage Produktions-GmbH, Grefrath (DE)

( * ) Notice: Subject to any disclaimer, the term of this patent is extended or adjusted under 35 U.S.C. 154(b) by 213 days.

(21) Appl. No.: 16/085,808

(22) PCT Filed: Apr. 18, 2017

(86) PCT No.: PCT/EP2017/059184
§ 371 (c)(1),
(2) Date: Sep. 17, 2018

(87) PCT Pub. No.: WO2017/182466
PCT Pub. Date: Oct. 26, 2017

(65) Prior Publication Data

US 2019/0100857 A1 Apr. 4, 2019

(30) Foreign Application Priority Data

Apr. 18, 2016 (EP) ..... 16165769

(51) Int. Cl.
*E01C 13/08* (2006.01)
*D01F 6/46* (2006.01)
(Continued)

(52) U.S. Cl.
CPC ..... *D01F 6/46* (2013.01); *D01F 1/02* (2013.01); *D01F 1/04* (2013.01); *D01F 1/06* (2013.01);
(Continued)

(58) Field of Classification Search
CPC ... E01C 13/08; D01F 6/46; D01F 8/06; D01F 8/12; D01F 1/04; D01F 1/06; D01F 1/02;
(Continued)

(56) References Cited

U.S. PATENT DOCUMENTS 5,587,118 A * 12/1996 Mallonee ..... D01D 5/253 264/172.13
2004/0180200 A1* 9/2004 Bertamini ..... D01F 1/04 428/364
(Continued)

FOREIGN PATENT DOCUMENTS

CN 1535296 A 10/2004
CN 101168612 A * 4/2008
(Continued)

OTHER PUBLICATIONS

China Linear Low Density Polyethylene LLDPE 7042, https://exportchem.en.made-in-china.com/product/SwbxVWclfnhv/China-Linear-Low-Density-Polyethylene-LLDPE-7042.html, 2020.*
(Continued)

*Primary Examiner* — Cheryl Juska
(74) *Attorney, Agent, or Firm* — Harness, Dickey & Pierce, P.L.C.

(57) ABSTRACT

A method for manufacturing an artificial turf fiber includes creating a polymer mixture that includes, 60-99% by weight of an LLDPE polymer and 1-15% by weight of an LDPE polymer. The method further includes extruding the polymer mixture into a monofilament; quenching the monofilament; reheating the monofilament; and stretching the reheated monofilament to form the monofilament into the artificial turf fiber.

18 Claims, 5 Drawing Sheets

(51) Int. Cl.

| | |
|---|---|
| ***D01F 1/02*** | (2006.01) |
| ***D01F 8/06*** | (2006.01) |
| ***D01F 1/06*** | (2006.01) |
| ***D06N 7/00*** | (2006.01) |
| ***D01F 1/04*** | (2006.01) |
| ***D01F 8/12*** | (2006.01) |

(52) U.S. Cl.
CPC ..... *D01F 8/06* (2013.01); *D01F 8/12* (2013.01); *D06N 7/0065* (2013.01); *E01C 13/08* (2013.01); *D06N 2201/0254* (2013.01); *D10B 2321/021* (2013.01); *D10B 2505/202* (2013.01); *Y10T 428/23993* (2015.04)

(58) Field of Classification Search
CPC ..... D06N 7/0065; D06N 2201/0254; Y10T 428/23993; D10B 2321/021; D10B 2505/202
See application file for complete search history.

(56) References Cited

U.S. PATENT DOCUMENTS

| | | | | |
|---|---|---|---|---|
| 2007/0154661 | A1* | 7/2007 | Stroppiana | D01D 5/42 428/21 |
| 2010/0040809 | A1* | 2/2010 | Muller | D01F 1/04 428/17 |
| 2012/0125474 | A1 | 5/2012 | Frenken et al. | |
| 2013/0030123 | A1* | 1/2013 | Martin | E01C 13/08 525/95 |
| 2013/0216736 | A1* | 8/2013 | Sandkuehler | C08L 23/08 428/17 |
| 2014/0243459 | A1* | 8/2014 | Mueller | C08L 23/06 524/100 |
| 2015/0125633 | A1* | 5/2015 | Nakamae | E01C 13/08 428/17 |
| 2017/0051453 | A1* | 2/2017 | Sick | D01D 5/12 |
| 2017/0096749 | A1* | 4/2017 | Mueller | D01F 6/30 |
| 2017/0121856 | A1* | 5/2017 | Sick | D01F 1/10 |
| 2018/0058017 | A1* | 3/2018 | Schmitz | D01F 6/90 |
| 2018/0177254 | A1* | 6/2018 | Neuman | A41G 1/009 |
| 2019/0048534 | A1* | 2/2019 | Lei | D01F 1/10 |
| 2019/0078235 | A1* | 3/2019 | Lopez | D01F 6/04 |
| 2019/0145057 | A1* | 5/2019 | Beauprez | D05C 15/22 428/17 |
| 2019/0177882 | A1* | 6/2019 | Sick | E01C 13/08 |
| 2019/0267928 | A1* | 8/2019 | Favroth | H02S 10/20 |
| 2020/0181853 | A1* | 6/2020 | Lopez | D01F 6/46 |
| 2020/0199784 | A1* | 6/2020 | Lopez | B32B 5/02 |
| 2020/0308777 | A1* | 10/2020 | Sick | E01C 13/08 |

FOREIGN PATENT DOCUMENTS

| | | | | |
|---|---|---|---|---|
| CN | 102493011 | A | | 6/2012 |
| CN | 102939410 | A | | 2/2013 |
| CN | 102965753 | A | * | 3/2013 |
| CN | 103057136 | A | | 4/2013 |
| CN | 103080208 | A | | 5/2013 |
| CN | 103221588 | A | | 7/2013 |
| CN | 104822716 | A | | 8/2015 |
| CN | 111395102 | A | * | 7/2020 |
| CN | 111395103 | A | * | 7/2020 |
| EP | 1378592 | A1 | | 1/2004 |
| EP | 2940212 | A1 | | 11/2015 |
| JP | 09220781 | A | * | 8/1997 |
| KR | 2008102068 | A | * | 11/2008 |
| KR | 100904020 | B1 | * | 6/2009 |
| KR | 101028574 | B1 | * | 4/2011 |
| KR | 1073966 | B1 | * | 10/2011 |
| KR | 1112983 | B1 | * | 2/2012 |
| KR | 2143595 | B1 | * | 8/2020 |
| WO | WO-2012005974 | A1 | | 1/2012 |

OTHER PUBLICATIONS

LDPE—Low Density Polyethylene for sale—LDPE manufacturer from China, http://linyiaosen4.sell.everychina.com/p-94919086-ldpe-low-density-polyethylene.html, 2020.*
CN 102493011 A, Google Patents translation, 2012.*
KR 101028574 B1, Google Patents translation, 2011.*
JP 09-220781, JPO translation, 1997.*
Office Action for corresponding Chinese Application No. 201780019560.3 dated May 8, 2020 and English translation.
International Search Report PCT/ISA/210 for International Application No. PCT/EP2017/059184 dated Jun. 20, 2017.
Written Opinion of the International Searching Authority PCT/ISA/237 for International Application No. PCT/EP2017/059184 dated Jun. 20, 2017.
International Preliminary Report on Patentability PCT/IPEA/409 for International Application No. PCT/EP2017/059184 dated Mar. 16, 2018.

* cited by examiner

ARTIFICIAL TURF FIBER WITH LLDPE AND LDPE

CROSS-REFERENCE TO RELATED APPLICATIONS

This application is a national phase under 35 U.S.C. § 371 of PCT International Application No. PCT/EP2017/059184 which has an International filing date of Apr. 18, 2017, which claims priority to European Application No. 16165769.7, filed Apr. 18, 2016, the entire contents of each of which are hereby incorporated by reference.

FIELD OF THE INVENTION

The invention relates to artificial turf and the production of artificial turf which is also referred to as synthetic turf. The invention further relates to the production of fibers that imitate grass, and in particular a product and a production method for artificial turf fibers based on polymer blends and of the artificial turf carpets made from these artificial turf fibers.

BACKGROUND AND RELATED ART

Artificial turf or artificial grass is surface that is made up of fibers which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

Artificial turf fields are brushed regularly to help fibers stand-up after being stepped down during the play or exercise. Throughout the typical usage time of 5-15 years it may be beneficial if an artificial turf sports field can withstand high mechanical wear, can resist UV, can withstand thermal cycling or thermal ageing, can resist inter-actions with chemicals and various environmental conditions. It is therefore beneficial if the artificial turf has a long usable life, is durable, and keeps its playing and surface characteristics as well as appearance throughout its usage time.

EP1378592 A1 describes a method for producing a synthetic fiber comprising a mixture of a plastomer and a polyethylene. The polyethylene may be a LLPE or HDPE.

Patent application CN 102493011 A (TAISHAN SPORTS INDUSTRY GROUP; LEUNG TAISHAN ARTIFICIAL TURF INDUSTRY) 13 Jun. 2012 describes wear-resisting artificial grass filaments. One embodiment comprises 85% LLDPE and 6% of a wear-resistant master batch, wherein about 50% of the master batch consist of LDPE.

WO 2012/005974 A1 (DOW GLOBAL TECHNOLOGIES LLC [US] Sandkuehler Peter [ES]; Martin Jill) 12 Jan. 2012 describes an oriented article, for example, a yarn, tape or filament made from a three component polymer blend. The blend comprises: (a) 20 to 50 parts of a first component (A) comprising a homogeneous ethylene polymer having a density between 0.85 and 0.90 gm/cm3, and a Mw/Mn less than 3, and a melt index (12) between 0.5 and 5 gm/10 minutes; and (b) 30 to 80 parts of a second component (B) comprising a heterogeneous branched ethylene polymer having a density between 0.91 and 0.945 gm/cm3, and a Mw/Mn greater than 3.5, and a melt index (12) between 0.5 and 10 gm/10 minutes; and (c) 2 to 25 parts of a third component (C) comprising an ethylene polymer having a density greater than 0.945 gm/cm3, and a melt index (12) between 0.01 and 10 gm/10 minutes. It may be desirable to manufacture artificial turf fibers having a set of desired properties e.g. in respect to smoothness, tensile strength, resistance to shear forces, and/or resistance to splicing of fibers.

SUMMARY

The invention provides for a method of manufacturing artificial turf in the independent claims. Embodiments are given in the dependent claims. Embodiments can freely be combined with each other if they are not mutually exclusive.

In one aspect, the invention relates to a method of manufacturing an artificial turf fiber. The method comprises:

- creating a polymer mixture comprising:
  - an LLDPE polymer in an amount of 60-99% by weight of the polymer mixture;
  - an LDPE polymer in an amount of 1-15% by weight of the polymer mixture;
- extruding the polymer mixture into a monofilament;
- quenching the monofilament;
- reheating the monofilament;
- stretching the reheated monofilament to form the monofilament into an artificial turf fiber.

"Low-density polyethylene" (LDPE) is a thermoplastic made from the monomer ethylene having a density in the range of 0.910-0.940 g/cm$^3$. Embodiments of the invention are based on LDPE whose density range is within the above specified sub-range.

"Linear low-density polyethylene" (LLDPE) as used herein is a substantially linear polymer (polyethylene), with significant numbers of short branches. LLDPE differs structurally from conventional LDPE because of the absence of long chain branching. The linearity of LLDPE results from the different manufacturing processes of LLDPE and LDPE. In general, LLDPE is produced at lower temperatures and pressures by copolymerization of ethylene and alpha-olefins.

Manufacturing an artificial turf comprising a mixture of LLDPE and LDPE in the above specified amount ranges for creating a monofilament in an extrusion and stretching process may be advantageous for multiple reasons:

The method allows manufacturing artificial turf fibers which are at the same time soft, flexible, resistant to shear forces (e.g. applied during extrusion or during stretching), have a high tensile strength and are resistant to splicing. "Splicing" as used herein relates to the splitting a fiber along its longitudinal axis.

Compared to a combination of a plastomer and an LLDPE or HDPE, a polymer mix comprising a combination of LLDPE and LDPE in the specified amount ranges surprisingly shows an increased softness, flexibility and improved tensile strength while showing the same or an even improved resistance against splitting. It has been observed that not all plastomers are well suited for preventing splitting in artificial turf fibers, presumably because plastomers—at least if provided in some particular amount ranges and/or having a particular density—appear not to generate a chain entanglement that can reliably prevent splicing and/or have negative side effects like making a fiber that has decreased tensile strength or flexibility and/or an increased brittleness.

Applicant has surprisingly observed that an optimal compromise between a high splicing resistance on the one hand and high tensile strength on the other hand can be achieved by combining specific amounts of LLDPE and LDPE polymers for generating an artificial turf fiber. Said fiber may in addition have a decreased brittleness and increased flexibility.

Applicant has also observed that the amount of LDPE used should be comparatively low, preferentially in the range of 1%-15%, more preferentially in the range of 5-8% by weight of the polymer mixture to ensure a high resistance to splicing in combination with a high tensile strength and high flexibility of the generated fiber.

Applicant has observed that the lack of long-chain branching in LLDPE allows the chains to slide by one another upon elongation without becoming entangled. As a result, fibers completely consisting of LLDPE are susceptible to splicing if a pulling force is applied on the surface of a fiber. Applicant has also observed that LLDPE has a higher tensile strength and a higher puncture resistance than LDPE and many plastomers. Applicant has surprisingly observed that, using a specific combination of LDPE and LLDPE in the above specified amount ranges allows manufacturing artificial turf fibers which can resist splicing and at the same time are soft, flexible and have a high tensile strength.

In a further beneficial aspect, the stretching-induced formation of polymer crystals within and at the surface of the monofilament increases the roughness of the fiber, thereby allowing a strong mechanical fixing in an artificial turf backing in embodiments wherein the monofilaments are partially embedded in a liquid film that later solidifies, e.g. a latex or PU film.

Applicant has further observed that, upon applying strong shear forces on a polymer mixture comprising LLDPE and LDPE polymers, e.g. by extruding a polymer mixture comprising LLDPE and LDPE polymers, LDPE molecules are deformed, the side branches of the LDPE molecules get entangled with the ones of other LDPE molecules and/or with LLDPE molecules. As a consequence of chain entanglement, the viscosity raises. Applicant found that an artificial turf fiber manufactured from a particular mixture of specific amounts of LDPE and LLDPE is soft and flexible and has high tensile strength (thanks to the LLDPE component) and is at the same time resistant against splicing (thanks to chain entanglement caused by the LDPE component). Applicant has observed that if the ratio of LLDPE to LDPE is too large, splicing may occur, and if said ratio is too low, the flexibility and tensile strength of the fiber may significantly decrease.

Contrary to polymers such as polyamide (PA), polyethylene (PE) is in general considered as a comparatively soft and flexible polymer that reduces the risk of injuries such as skin burns. LLDPE is a form of PE that is shear sensitive because of its shorter chain branching. LLDPE allows for a faster stress relaxation of the polymer chains after extrusion or stretching compared with stress relaxation of an LDPE of equivalent melt index. Stress resistance may be particularly beneficial in the context of artificial turf fiber production: the stretching process triggers the formation of crystalline portions on the surface (and inner portions) of the stretched fiber. The crystals increase the surface roughness and thus allow for a better mechanical fixing of the fiber in a surface backing.

According to embodiments, the polymer mixture comprises the LDPE polymer in an amount of 5-8% by weight of the polymer mixture and comprises the LLDPE polymer in an amount of 60%-95% by weight of the polymer mixture. According to preferred embodiments, the polymer mixture comprises the LDPE polymer in an amount of 5-8% by weight of the polymer mixture and/or comprises the LLDPE polymer in an amount of 65-75% by weight of the LLDPE polymer mixture.

The "polymer mixture" may comprise additional substances, e.g. filler materials and/or additives, so the total amount of the LLDPE polymer and the LDPE polymer do not have to sum up to 100% of the weight of the polymer mixture.

According to embodiments, the LDPE polymer has a density in a range of 0.919 g/cm$^3$ to 0.921 g/cm$^3$.

According to some embodiments, the LLDPE has a density in a range of 0.918 g/cm$^3$ to 0.920 g/cm$^3$.

Applicant has surprisingly observed that the ability of a fiber to resist splicing and to show high tensile strength also depends on the density of the respective polymers, presumably because the density corresponds to the number and position of branches and other structural features related to the branching of a PE molecule. The above density ranges have been observed to be particularly suited to provide for a fiber combining splicing resistance and tensile strength.

According to other embodiments, the LLDPE polymer comprises a first LLDPE polymer having a density in a range of 0.918 g/cm$^3$ to 0.920 g/cm$^3$ and comprises a second LLDPE polymer having a density in a range of 0.914 g/cm$^3$ to 0.918 g/cm$^3$.

According to embodiments, the polymer mixture comprises the second LLDPE polymer in an amount of 7-13% by weight of the polymer mixture. The rest of the LLDPE polymer in the mixture may consist of the first LLDPE having the above specified, higher density.

Adding a second, "low density" LLDPE in addition to the first, "medium density" LDPE may be advantageous as the risk of splicing is further reduced: the low density LLDPE is folded in three-dimensional space in a less dense manner (see FIG. 1) and may thus reduce the amount of crystalline portions that are created in the stretching process. This reduces the brittleness of the fiber and thus may also reduce the risk of splicing. Thus, by choosing a particular amount of LDPE and LLDPE, splicing may be prevented by promoting chain entanglement, whereby the risk of splicing may be further reduced by adding low-density LLDPE.

In a further beneficial aspect, adding an amount of said "low density" LDPE makes the fiber smoother and reduces risk of skin burns.

According to embodiments, the LLDPE polymer is added to the polymer mixture in the form of

- a "main" LLDPE polymer component lacking additives. The "main" or "pure" LLDPE polymer can be added, for example, in an amount of 47-88% by weight of the polymer mixture, preferentially, in an amount of 70-75% by weight of the polymer mixture; and
- a further LLDPE polymer comprising one or more additives, the second LLDPE polymer being added, for example, in an amount of 7-13% by weight of the polymer mixture, preferentially in an amount of approximately 10%. Said additive-containing LLDPE polymer fraction may also be referred to as "master batch"; the "main" LLDPE polymer component and the master batch may have the above mentioned density range of of 0.918 g/cm$^3$ to 0.920 g/cm$^3$.
- optionally, the low density LLDPE polymer may be added, preferentially in an amount of 7-13% by weight of the polymer mix.

Preferentially, the LLDPE polymer type of the main LLDPE component and of the "master batch" is identical and the only difference is that the master batch in addition comprises the additives. For example, the LDPE, the LLDPE master batch and the LLDPE component(s) lacking the additives may respectively be added to a container in the form of polymer granules. The granules are mixed and heated until all polymer granules have molten and a liquid polymer mixture is generated that is used for extruding the monofilament. Adding additives solely via a separate master batch that is based on the main type of polymer (here: the LLDPE polymer) may be advantageous as it is possible to modify some properties like color, flame retardants and others independently from the type and relative amount of the LLDPE and LDPE polymers respectively lacking the additives. Thus, it is possible to modify e.g. the color or the concentration of a flame retardant without deviating from an optimal ration of LLDPE and LDPE. Likewise, it is possible to slightly adapt the ratio of medium-density LLDPE and low density LLDPE without modifying the concentration of the additives in order to "fine tune" physic-chemical properties of the monofilament and fiber such as resilience, resistance to shear forces and splicing, flexibility, softness and tensile strength.

According to embodiments, the polymer mixture further comprises one or more additives. The additives may be added to the polymer mixture e.g. by adding the master batch. The additives are selected from a group comprising: a wax, a dulling agent, a UV stabilizer, a flame retardant, an anti-oxidant, a pigment, a filling material and combinations thereof. The filling material may also be added separately to the polymer mix and may constitute a significant portion of the final polymer mixture that is extruded.

According to embodiments, the LLDPE polymer is a polymer created by a polymerization reaction under the presence of a Ziegler-Natta catalyst.

According to some embodiments, the Ziegler-Natta catalyst is a heterogeneous supported catalyst based on titanium compounds in combination with cocatalysts, e.g. organoaluminium compounds such as triethylaluminium.

According to other embodiments, the Ziegler-Natta catalyst is a homogeneous catalyst. Homogeneous catalysts are usually based on complexes of Ti, Zr or Hf and are preferentially used in combination with a different organoaluminium cocatalyst, methylaluminoxane (MAO). Using a Ziegler-Natta catalyst may have the advantage that the branches of the generated LLDPE are distributed more randomly, e.g. show an atactic orientation. This may ease the entanglement with branches of LDPE molecules.

According to embodiments, the LLDPE polymer is a polymer created by a polymerization reaction under the presence of a metallocene catalyst. Using metallocene for catalyzing the polymerization for generating the LLDPE polymer may be advantageous as this particular form of catalysts ensures that the branching occurs in a less random and more defined manner. As a consequence of using metallocene as a catalyst, the number of branches per LLDPE molecule does not follow a normal distribution but rather follows a distribution having only one or very few (e.g. 1-3) peaks for the frequencies of branching per polymer molecule. Generating LLDPE polymers whose branch lengths are more randomly distributed may ease the entanglement with branches of LDPE molecules.

For example, a metallocene catalyst may be used together with a cocatalyst such as MAO, (Al(CH3)xOy)n. According to some examples, the metallocene catalyst has the composition Cp2MCl2 (M=Ti, Zr, Hf) such as titanocene dichloride. Typically, the organic ligands are derivatives of cyclopentadienyl. Depending of the type of their cyclopentadienyl ligands, for example by using an Ansa-bridge, metallocene catalysts can produce polymers of different tacticity and different branching frequencies. A tactic macromolecule in the IUPAC definition is a macromolecule in which essentially all the configurational (repeating) units are identical. The tacticity, branching frequency and distribution will have an effect on the physical properties of the polymer. The regularity of the macromolecular structure influences the degree to which it has rigid, crystalline long range order or flexible, amorphous long range disorder. According to embodiments, the tacticity of a polymer mixture that is used for manufacturing LLDPE or LDPE granules for use in artificial turf fiber production may be measured directly using proton or carbon-13 NMR. This technique enables quantification of the tacticity distribution by comparison of peak areas or integral ranges corresponding to known diads (r, m), triads (mm, rm+mr, rr) and/or higher order n-ads depending on spectral resolution. Other techniques that can be used for measuring tacticity include x-ray powder diffraction, secondary ion mass spectrometry (SIMS), vibrational spectroscopy (FTIR) and especially two-dimensional techniques.

According to embodiments, the LLDPE polymer is a polymer created by copolymerizing ethylene with 5-12% α-olefins having 3-8 carbon atoms, e.g. butene, hexene, or octane. The degree of crystallinity of the created LLDPE depends on the amount of added co-monomers and is typically in the range of only 30-40%, the crystalline melting range is typically in the range 121-125° C.

The production of LLDPE is initiated by a catalyst t. The actual polymerization process can be done either in solution phase or in gas phase reactors. Usually, octene is the comonomer in solution phase while butene and hexene are copolymerized with ethylene in a gas phase reactor.

According to embodiments, the LLDPE polymer is a polymer comprising 0.001-10 tertiary C-atoms per 100 C atoms of the polymer chain. Preferably, the LLDPE polymer comprises 0.8-5 tertiary C atoms/100 carbon atoms of the polymer chain.

According to embodiments, the LDPE polymer is a polymer more than 0.001, preferentially more than 1 tertiary C-atom/100 C atoms of the polymer chain. The number of tertiary C-atoms is a measure of the degree of branching. Using an LLDPE and/or LDPE polymer having the above specified degree of branching may be advantageous as said degree of branching has been observed to cause a strong entanglement between LLDPE and LDPE polymer molecules which protects the polymer fiber against splicing. According to embodiments, manufacturing the artificial turf fiber comprises forming the stretched monofilament into a yarn. Multiple, for example 4 to 8 monofilaments, could be formed or finished into a yarn.

According to embodiments, the method further comprises weaving, spinning, twisting, rewinding, and/or bundling the stretched monofilament into the artificial turf fiber. This technique of manufacturing artificial turf is known e.g. from United States patent application US 20120125474 A1.

According to embodiments, the polymer mixture is a liquid polymer mixture and comprises two or more different, liquid phases. A first one of the phases comprises a first dye and the components of the polymer mixture according to any one of the embodiments described previously. For example, said first phase may comprise a mixture of the first and the second LLDPE polymer and the LDPE polymer. The second phase may comprise a second dye and an additional polymer, e.g. polyamide, that is immiscible with the first phase. The second dye may have a different color than the first dye, the additional polymer forming polymer beads within the first phase.

The stretching of the reheated monofilament deforms the polymer beads into threadlike regions. The extrusion of the two-phase-polymer mixture into a monofilament results in the extrusion and generation of a monofilament comprising a marbled pattern of a first color of the first dye and a second color of the second dye.

Thus, a liquid polymer mixture may be created wherein the two different dyes are separated in two different phases wherein one of the phases is "emulsified" in the other phase in the form of beads. This may be advantageous as it is not necessary to use or create customized extruders which mechanically prevent a premature intermixing of the two dyes, thereby ensuring that a monofilament with a marbled pattern rather than a monofilament with a color being the intermediate of the first and second color is created. Thus, embodiments of the invention allow using the same extrusion machinery for creating marbled monofilaments as for creating monochrome monofilaments. This may reduce production costs and may increase the diversity of artificial turf types that can be created with a single melting- and extrusion apparatus.

Moreover, complicated coextrusion, requiring several extrusion heads to feed one complex spinneret tool is not needed in order to provide for artificial turf that accurately reproduces the texture of natural grass.

In a further beneficial aspect, the polymer mixture completely or largely constituting—together with the first dye—the first phase may not delaminate from the other polymer constituting—together with the second dye—completely or largely the second phase, even in case two different types of polymers are used in the two phases, e.g. the various forms of PE in the first phase and Polyamide in the second phase. The thread-like regions are embedded within the polymer mixture of the first phase. It is therefore impossible for them to delaminate.

According to embodiments, a compatibilizer is added to the polymer mixture and interfaces the first and second phases, thereby further preventing the delamination of the polymers in the different phases.

A further advantage may possibly be that the thread-like regions are concentrated, due to fluid dynamics during the extrusion process, in a central region of the monofilament during the extrusion process, while there is still a significant portion of the thread-like regions also on the surface of a monofilament to produce the marble pattern appearance. Thus, the other polymer (that may be of a more rigid material than LLDPE and LDPE in the first phase) may be concentrated in the center of the monofilament and a larger amount of softer plastic on the exterior or outer region of the monofilament. This may further lead to an artificial turf fiber with more grass-like properties both in terms of rigidity, surface smoothness and surface coloration and texture.

In contrast to alternative approaches where a marble color pattern is printed or painted onto the surface of an extruded filament, embodiments of the method result in a monofilament that comprises the marble color pattern not only on its surface but also inside. In case a filament should be split, its surface abraded or otherwise damaged, the marble color pattern will not be removed as it is not confined to the surface of the monofilament According to embodiments, the polymer mixture comprises 0.2 to 35% by weight the additional polymer, and more preferentially comprises 2 to 10% by weight the additional polymer. According to embodiments, the amount of the "pure" LLDPE having a density in a range of 0.918 g/cm$^3$ to 0.920 g/cm$^3$, is chosen such that the said LLDPE polymer, the LLDPE master batch, the optional low density LLDPE, the LDPE polymer, the other polymer and the optional additives and/or filler substances add up to 100%.

According to embodiments, the additional polymer is a polar polymer. According to embodiments, the additional polymer is any one of the following: polyamide, polyethylene terephthalate (PET), and polybutylene terephthalate (PBT).

According to embodiments, the marble pattern of the monofilament reproduces color patterns of natural grass. For example, the first dye is of green color and the other dye is of yellow or light-green color. This may be advantageous as an artificial turf fiber is produced that faithfully reproduces the appearance of natural grass.

According to embodiments, the first dye is phthalocyanine green in a concentration of 0.001-0.3% by weight, preferably 0.05-0.2% by weight of the first phase. Preferentially, the first dye has a green or dark green color. According to embodiments, the second dye is an azo-nickel pigment complex in a concentration of 0.5-5, more preferentially of 1.5-2 percent by weight of the second phase. For example, the azo-nickel pigment "BAYPLAST®Gelb 5GN" of LANXESS may be used as the second dye. Preferentially, the second dye has a yellow, light green or yellow-green color.

According to embodiments, the extrusion is performed at a pressure of 40-140 bars, more preferentially between 60-100 bars. The polymer mixture may be created by adding polymer granules to a solid polymer composition that is mixed and heated until all polymers are molten. For example, the polymer mixture may be heated to reach at the time of extrusion a temperature of 190-260° C., more preferentially 210-250° C.

According to embodiments, the stretching comprises stretching the reheated monofilament according to a stretch factor in the range of 1.1-8, more preferentially in the range of 3-7.

According to embodiments, the quenching is performed in a quenching solution having a temperature of 10-60° C., more preferentially between 25° C.-45° C.

According to embodiments, in the marble pattern of the monofilament the occurrence of the two different colors changes preferentially every 50-1000 μm, more preferentially every 100-700 μm. According to embodiments the marble pattern of the monofilament reproduces color patterns of natural grass.

According to embodiments, the artificial turf fiber extends a predetermined length beyond the artificial turf backing. The threadlike regions have a length less than one half of the predetermined length.

According to embodiments, the method further comprises manufacturing an artificial turf by incorporating the artificial turf fiber into an artificial turf backing. According to embodiments, the incorporation of the artificial turf fiber into the artificial turf backing comprises tufting the artificial turf fiber into the artificial turf backing and binding the artificial turf fibers to the artificial turf backing.

According to embodiments, the incorporation of the artificial turf fiber into the artificial turf backing comprises weaving the artificial turf fiber into the artificial turf backing.

In a further aspect, the invention relates to an artificial turf fiber manufactured according to the method of any one of the embodiments described herein.

In a further aspect, the invention relates to an artificial turf manufactured according to the method of any one of the embodiments described herein.

In a further aspect, the invention relates to an artificial turf fiber comprising:

60-99% by its weight a LLDPE polymer, e.g. 60-95% by its weight; and 1-15% by its weight a LDPE polymer, e.g. 5-8% by its weight.

According to embodiments, the LLDPE polymer has a density in a range of 0.918 g/cm$^3$ to 0.920 g/cm$^3$ and/or the LDPE polymer has a density in a range of 0.919 g/cm$^3$ to 0.921 g/cm$^3$.

According to other embodiments, the LLDPE polymer consists of a first LLDPE polymer having a density in a range of 0.918 g/cm$^3$ to 0.920 g/cm$^3$ and a second LLDPE polymer having a density in a range of 0.914 g/cm$^3$ to 0.918 g/cm$^3$. The LDPE polymer has a density in a range of 0.919 g/cm$^3$ to 0.921 g/cm$^3$.

In a further aspect, the invention relates to an artificial turf comprising an artificial turf textile backing and the artificial turf fiber as described for embodiments of the invention. The artificial turf fiber is incorporated into the artificial turf backing.

According to embodiments, the monofilament is an extruded and/or stretched monofilament. The creation of the artificial turf fiber comprises extruding the polymer mixture and stretching the monofilament to form the monofilament into the artificial turf fiber.

According to embodiments, the compatibilizer is any one of the following: grafted maleic acid anhydride (MAH), ethylene ethyl acrylate (EEA), a maleic acid grafted on polyethylene or polyamide; a maleic anhydride grafted on free radical initiated graft copolymer of polyethylene, SEBS (styrene ethylene butylene styrene), EVA (ethylene-vinyl acetate), EPD (ethylene-propylene diene), or polypropylene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer.

Using a mixture of polymers of different types, e.g. the apolar polyethylene(s) in the first phase and the polar polyamide in the second phase as described above has the advantage that an artificial turf fiber is created that shows a marbled color pattern and that has increased durability against wear and tear due to the more rigid PA and at the same time a smoother surface and increased elasticity compared to pure-PA based monofilaments. The compatibilizer prevents splicing between polymer regions relating to different phases.

According to embodiments, the quenching solution, e.g. a water bath, has a temperature (right after the extrusion nozzle or hole(s)) of 10-60° C., more preferentially between 25° C.-45° C., and even more preferentially between 32° C.-40° C. Said temperature of the quenching solution may be advantageous as it allows, within a defined time interval between extrusion of the monofilament and solidification of the multiple liquid polymer phases, multiple polymer domains of a particular phase to unify, thereby resulting in threads of the first polymer having a desired average thickness, before the solidification prohibits any further migration and fusion of polymer domains.

Moreover, the resulting time interval during which the polymer phases are liquid and during which dye can potentially diffuse to the other phase is so short that significant dye diffusion to the other phase is prohibited. Moreover, it has been observed that under high pressure and at turbulent flow condition in the polymer mixture (as has been observed at extrusion), multiple polymer domains of a given phase do not unify. Under these "turbulent" conditions, the threads of the first polymer phase are often so thin that a marbled structure would not be observable if the extruded monofilament would solidify immediately after extrusion. However, by using a quenching liquid temperature and extrusion mass temperature as described above, the different polymer domains of the same phase have sufficient time to unify after the polymer mixture flow has become laminar, thereby forming threads whose size and thickness is large enough as to provide for a marbled color impression if viewed by a human eye, e.g. at a distance of 15 cm or less.

According to embodiments, the extrusion is performed at a pressure of 80 bar, the polymer mixture at time of extrusion has a temperature of 230° C., the stretch factor is 5 and the quenching solution, e.g. a water bath, has a temperature of 35° C.

According to embodiments, the first and second dyes respectively are an inorganic dye, an organic dye or a mixture thereof. The above mentioned conditions will basically prohibit a diffusion of the dyes into the respective other phase irrespective of the dyes' polarity or molecular weight.

This may be advantageous as the diffusion of the dyes into the respective other phase and thus a mixing of the dyes is prevented, thereby ensuring that a marbled color expression is generated for an arbitrary combination of first and second dyes.

According to embodiments, the threadlike regions have a length less than 2 mm.

According to embodiments, the extrusion-mass temperature, stirring parameters of a mixer are chosen such that the average diameter of the beads in the molten polymer mixture before extrusion is less than 50 micrometer, preferentially between 0.1 to 3 micrometer, preferably 1 to 2 μm.

Said features in combination with quenching conditions that allow a unification of polymer domains of the same phase once the extruded polymer mix has reached laminar flow state may be advantageous as they will support a formation of a marble structure in which the occurrence of the two different colors changes preferentially every 50-1000 μm, more preferentially every 100-700 μm.

Thus, during extrusion, the polymer domains of the second polymer phase is very fine-granularly dispersed within the first polymer phase and the portions on the surface of the monofilaments showing the second color may form as coarse-grained structures by unification (merging) of multiple second phase domains after extrusion until the monofilament solidifies. This may allow for a better intermixing of the first and second polymer phases and prohibit delamination.

The term "domain", "polymer domain", "polymer bead" or "beads" may refer to a localized region, such as a droplet, of a polymer that is immiscible in a surrounding phase of another polymer. The polymer beads may in some instances be round or spherical or oval-shaped, but they may also be irregularly-shaped.

A "phase" as used herein is a region of space (a thermodynamic system), throughout which many or all physical properties of a material are essentially uniform. Examples of physical properties include density, index of refraction, magnetization and chemical composition. A simple description is that a phase is a region of material that is chemically uniform, physically distinct, and mechanically separable. For example, a polymer mixture may form in the molten state a first and a second liquid phase, whereby the first phase comprises a mixture of a first and a second LLDPE polymer and a LDPE polymer and a first dye, and the second phase may comprise another polymer, e.g. PA, and a second dye.

A "polymer" as used herein is a polyolefin.

It is understood that one or more of the aforementioned embodiments of the invention may be combined as long as the combined embodiments are not mutually exclusive.

BRIEF DESCRIPTION OF THE DRAWINGS

In the following embodiments of the invention are explained in greater detail, by way of example only, making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
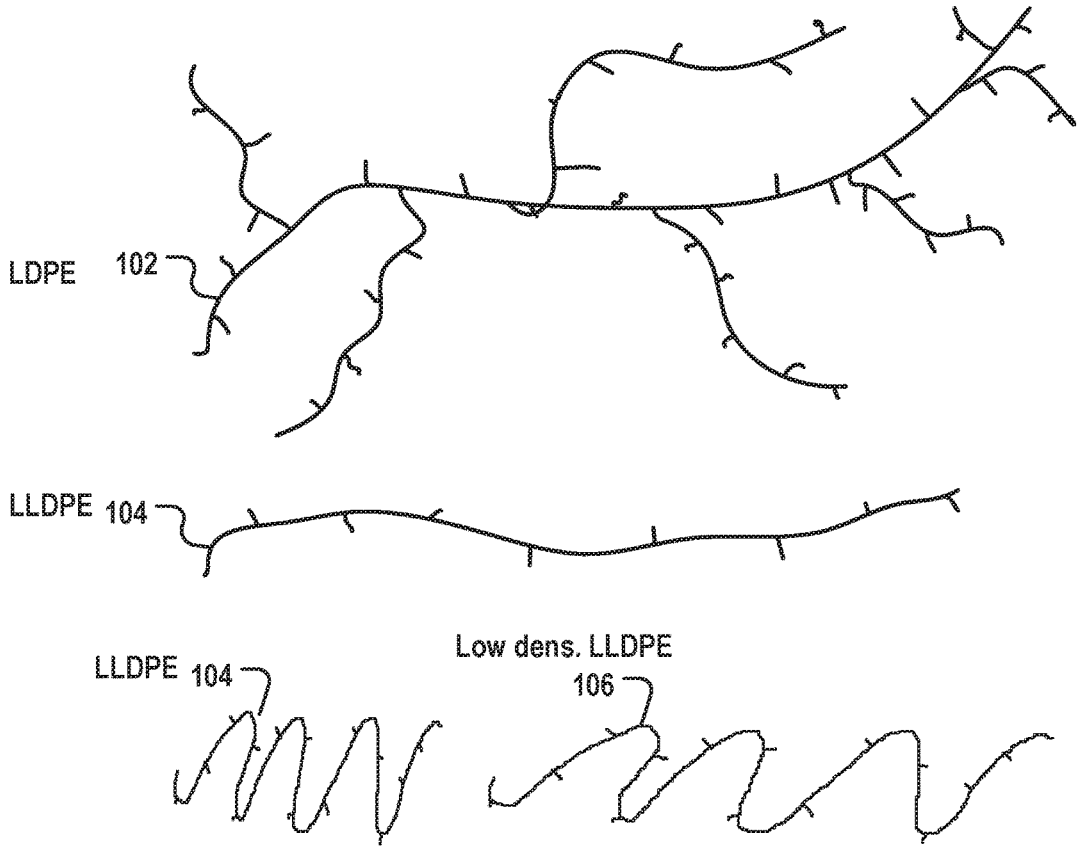
FIG. 1 shows an LDPE and an LLDPE molecule.

FIG. 1 shows a single LDPE molecule 102 as it may be used in embodiments of the invention. It comprises one or more long main chains and a plurality of small side chains extending from any one of the main chains. The small side chains are typically 2-8 carbon atoms long. In addition, FIG. 1 shows a single LLDPE molecule 104. The LLDPE molecule does not comprise larger side chains. It only comprises a single, long polyethylene main chain and a plurality of small side chains extending from the main chain.

Applicant has observed that the type of catalyst used during the polymerization reaction determines the tacticity and the branching properties of a PE molecule (number and distances of branches in a main chain, length of side chains, etc). Preferentially, metallocene catalysts are used for creating the LLDPE, because they result in a more regular branching pattern than other catalysts (which typically trigger the generation of LLDPE polymers whose number and distance of branches and the length of the individual branches follows a normal distribution). Generating LLDPE polymers with a defined, regular (not normally distributed) branching pattern can be beneficial as the properties of a monofilament resulting from a mixture of such an LLDPE polymer with an LDPE polymer can thus be predicted more clearly. Moreover, the density is then a more accurate indicator of the tacticity and the branching pattern.

In addition, the lower portion of FIG. 1 illustrates that the first, "medium density" LLDPE 104 is folded more densely than the second, "low density" LLDPE 106.

Figure 2:
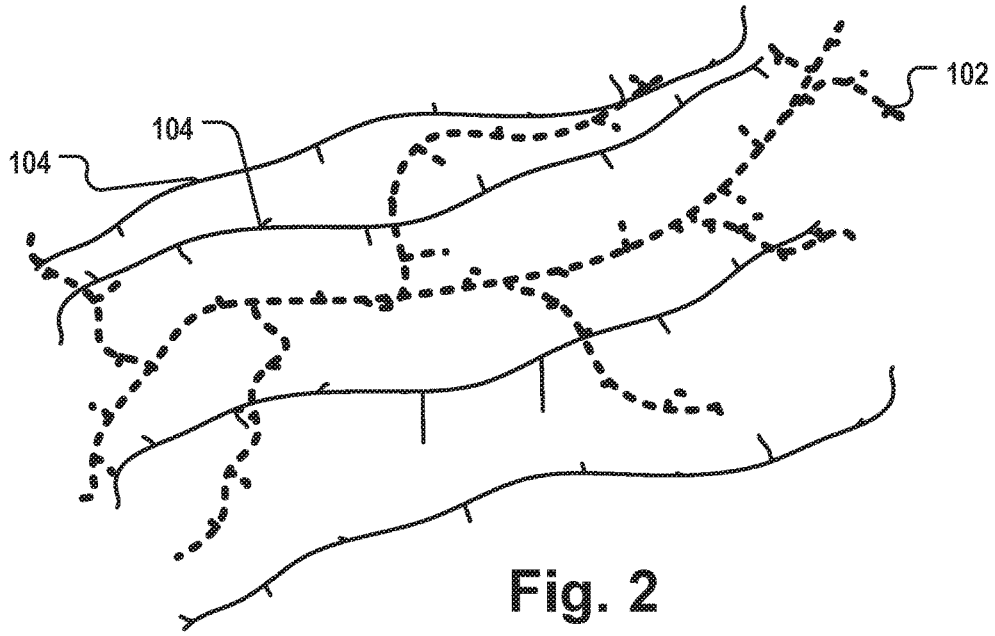
FIG. 2 shows an entanglement of one LDPE and multiple LLDPE molecules.

FIG. 2 shows chain entanglement between a single LDPE molecule 102 and multiple LLDPE molecules 104. The entanglement is achieved by Van-der-Waals forces between the larger and minor branches of the LPDE with the main chain and the minor side chains of one or more LLDPE molecules. Due to the lack of larger side chains, a polymer fiber solely consisting of LLDPE would be susceptible to splicing. By adding some LDPE molecules at a particular weight ratio to a polymer mixture largely consisting of LLDPE, and by choosing the LDPE and LLDPE polymers of a particular density, it is possible to manufacture a fiber that has a high split resistance and at the same time high tensile strength.

Figure 3:
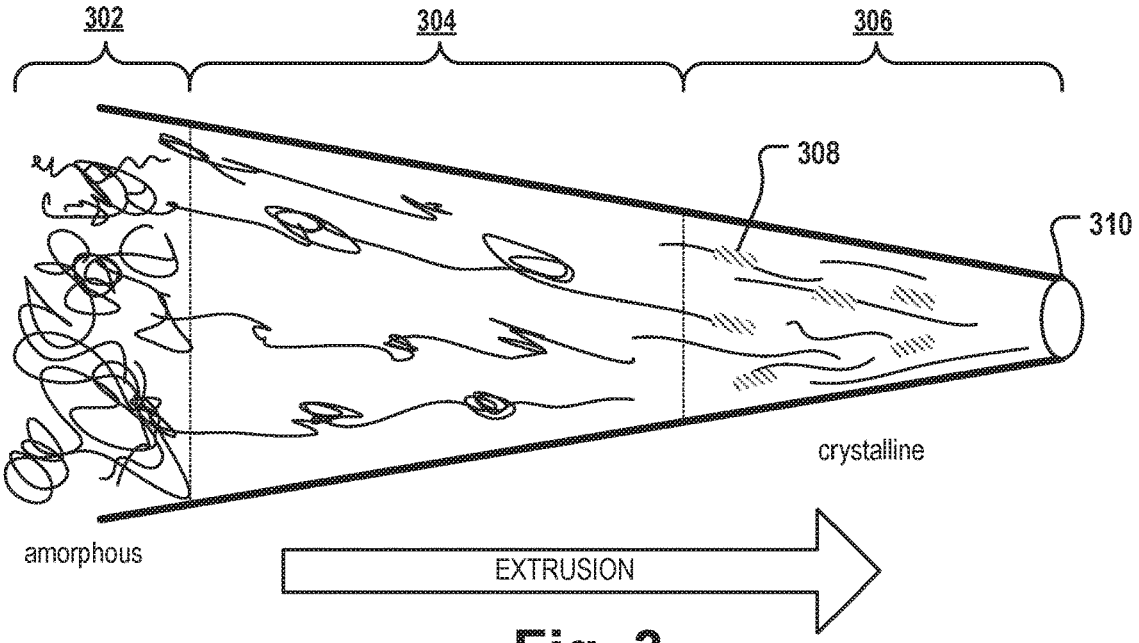
FIG. 3 shows the effect of shear forces during extrusion.

FIG. 3 shows a section through an area within a cylindrical extrusion nozzle. In a first area 302, the polymers of a liquefied polymer mixture are mostly in an amorphous state, i.e., there are only few or no crystalline regions and the polymer molecules do not show any preferred orientation in one dimension. In a second area 304 that corresponds to an area of increased shear forces, the polymer molecules are sheared and pulled at least partially in the direction of the opening 310 of the nozzle. In the area 306 corresponding to high shear forces, the LLDPE and partially also the LDPE molecules are at least partially disentangled, oriented and form crystalline portions 308. However, according to preferred embodiments, the majority of crystalline portions is created later in the stretching process.

Using the LLDPE-LDPE mixture according to embodiments of the invention are particularly beneficial for preventing splicing in artificial turf fibers which are stretched in the manufacturing process. The extrusion, and in particular the stretching, results in an at least partial disentanglement and parallel orientation of LLDPE molecules which again causes an increased susceptibility of the fiber to splicing. By adding the appropriate amount of LDPE, in particular LDPE of a particular density, to the polymer mixture, the splicing can be prohibited even in fibers that are stretched during manufacturing.

Figure 4:
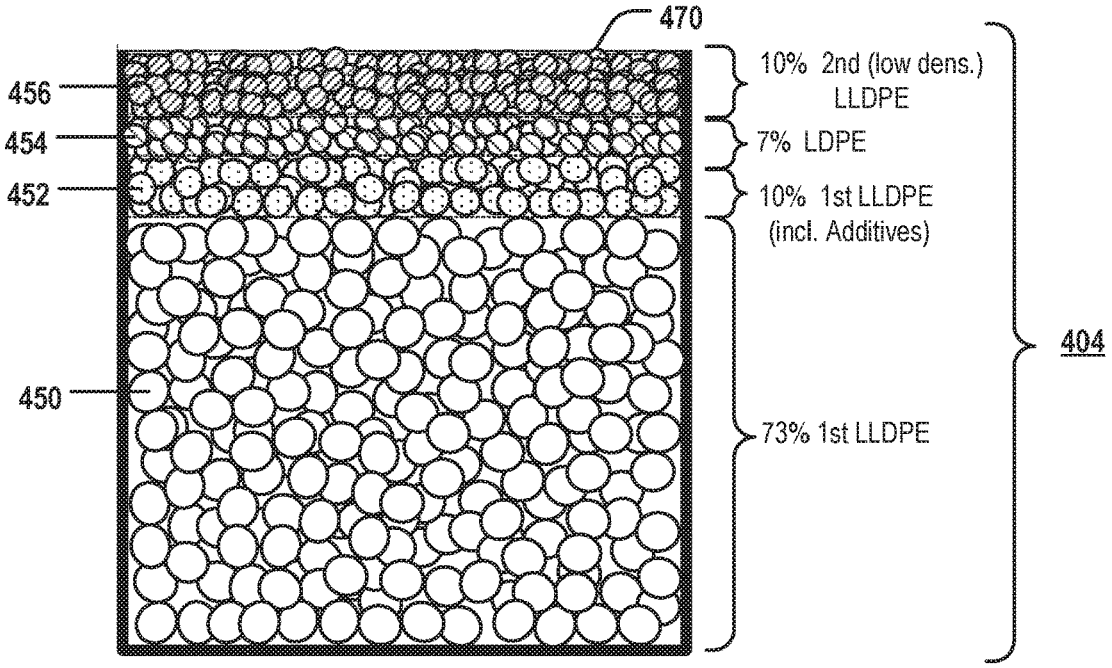
FIG. 4 shows a cross-section of a granular polymer mixture.

FIG. 4 shows a cross-section of a granular polymer mixture 470 according to one embodiment of the invention. The polymer mixture comprises the following components e.g. in the form of polymer granules that are molten later:

- a "pure" first LLDPE polymer 450 of a density of 0.919 g/cm$^3$ and at an amount of 73% by weight of the polymer mixture. The first LLDPE polymer preferentially lacks any additives;
- a "master batch" 452 comprising the first LLDPE polymer having a density of 0.919 g/cm$^3$ and at an amount of 10% by weight of the polymer mixture. The master batch may comprise additives. An LDPE polymer 454 of a density of 0.920 g/cm$^3$ and at an amount of 7% by weight of the polymer mixture.
- a second, low density LLDPE polymer 456 of a density of 0.916 g/cm$^3$ and at an amount of 10% by weight of the polymer mixture.

Depending on the embodiments, the amount of the filler material, the master batch, the LDPE and the first and second LLDPE polymer may vary. Preferentially, the amount of the first LLDPE polymer 450 lacking the additives is in this case adapted such that all components of the polymer mixture add up to 100%.

In the depicted example, the first LLDPE polymer in fraction 450 and in the master batch 452 and the additives contained in the master mix may constitute 83% by weight of the polymer mixture 470. In other embodiments (not shown), the polymer mixture 470 may comprise up to 39% filler material. In case the polymer mixture comprises 1% LDPE polymer and 99% LLDPE polymer (no filler or additives), an LDPE/LLDPE weight ratio of 1:99 is used. In case the polymer mixture comprises 15% LDPE polymer and 60% LLDPE polymer (a large amount of filler and additives may be used), an LDPE/LLDPE weight ratio of 15:60 is used. Preferentially, the LDPE/LLDPE weight ratio is between 5:95 and 8:60, i.e., between 5.3% and 13.3%.

Figure 6:
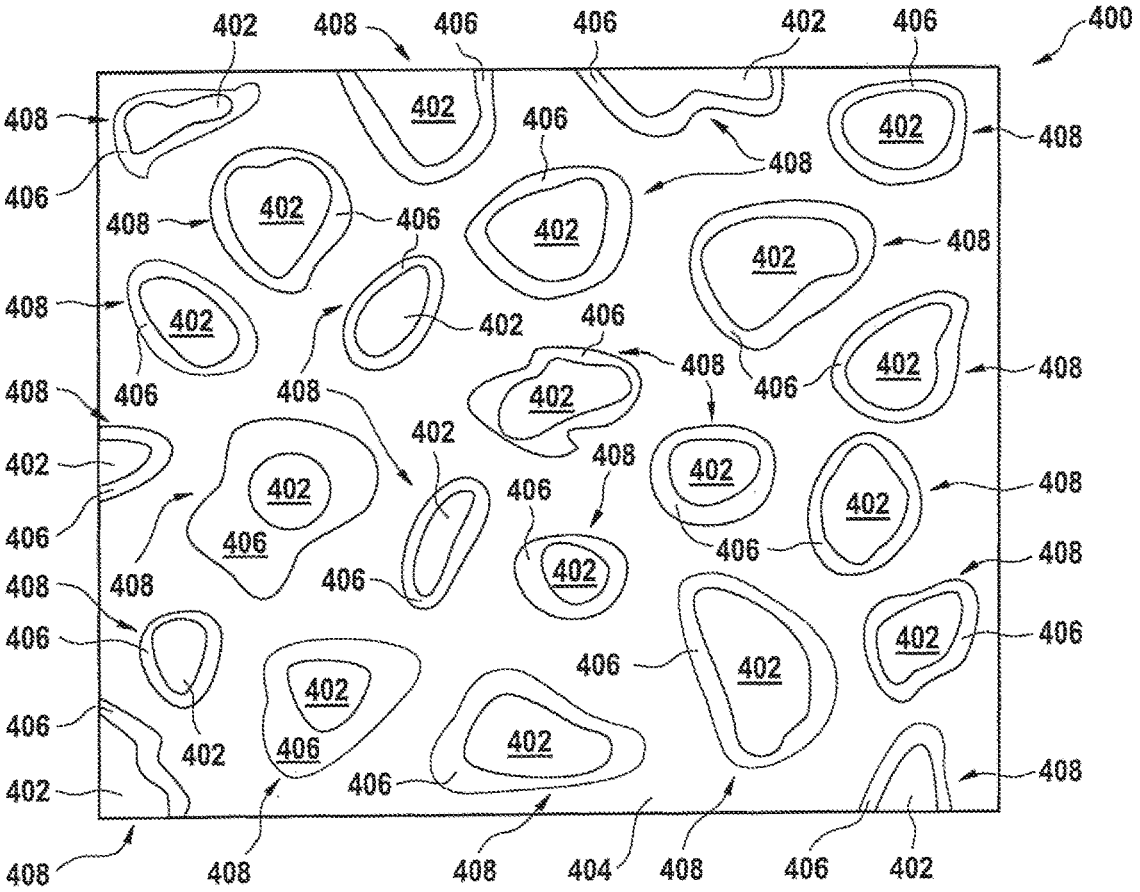
FIG. 6 shows a schematic drawing of a multi-phase polymer mixture.

In some embodiments depicted e.g. in FIG. 6, the polymer components 450-456 together form a first liquid phase 404 that may in addition comprise an additional polymer, e.g. PA, that may form a second phase 402 that forms beads 408 within the first phase. In this case, the amount of the first LLDPE is reduced in accordance with the amount of the other polymer.

Figure 5:
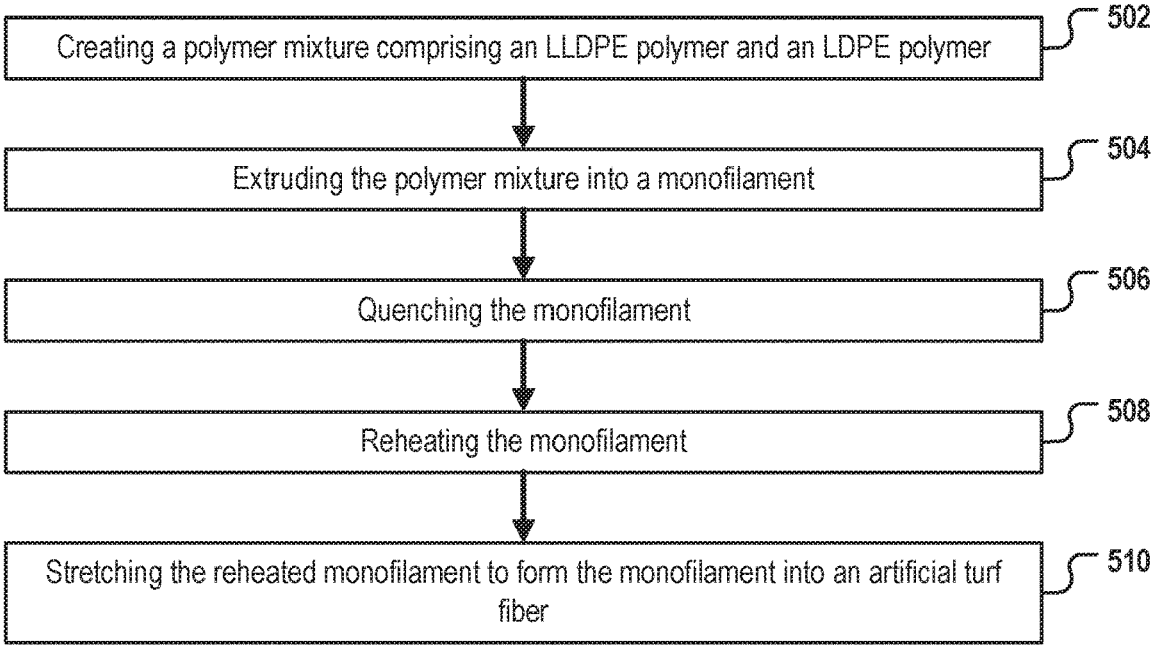
FIG. 5 shows a flowchart which illustrates an example of a method of manufacturing artificial turf fiber.

FIG. 5 shows a flowchart which illustrates an example of a method of manufacturing artificial turf fiber. First in step 502 a polymer mixture is created. The polymer mixture is comprises at least an LLDPE polymer having a density of 0.918 g/cm$^3$ to 0.920 g/cm$^3$ and a first LLDPE polymer having a density of 0.920 g/cm$^3$ in an amount of about 5-8% by weight of the polymer mixture. The LLDPE polymer may be added in the form of pure LLDPE granules 450 and master batch LLDPE granules 452 as depicted, for example, in FIG. 4. The master batch LLDPE polymer granules may comprise additives. Preferentially, the LLDPE polymer in the polymer granules 450, 452 is of an identical type. Optionally, the polymer mixture may comprise about 10% of a "low density" LLDPE.

Depending on the embodiment, it is possible that the polymer mixture comprises a small fraction of an additional polymer, e.g. PA, and optionally a compatibilizer, as depicted and discussed in further detail in FIG. 6.

The polymer mixture may at first have the form of a polymer granules mixture. By heating the granules, a liquid polymer mixture is created. Thereby, the polymer mixture may optionally be stirred at a stirring rate suitable to ensure that the molten polymers and additives are homogeneously mixed.

In the next step 504 the polymer mixture is extruded into a monofilament. Next in step 506 the monofilament is quenched or rapidly cooled down. Next in step 508 the monofilament is reheated. In step 510 the reheated monofilament is stretched to form the monofilament into the artificial turf fiber. Said step is depicted in greater detail in FIG. 3.

Additional steps may also be performed on the monofilament to form the artificial turf fiber. For instance the monofilament may be spun or woven into a yarn with desired properties. Then, the artificial turf fiber is incorporated into an artificial turf backing. For example be, this can be done by tufting or weaving the artificial turf fiber into the artificial turf backing. Finally, the artificial turf fibers are bound to the artificial turf backing. For instance the artificial turf fibers may be glued or held in place by a coating or other material. According to one embodiment, at least a portion of the artificial turf fibers extends through a carrier, e.g. a piece of textile, to the backside of said carrier. A fluid latex or polyurethane (PU) film is be applied on the backside of said backing (i.e., the side opposite to the side from which the larger portions of the fibers emanate) such that at least the portion of the fiber at the backside of the carrier is wetted and surrounded by said latex or PU film. When the film solidifies, the fibers are fixed in the latex or PU backing by mechanical, frictional forces. This effect is at least in part caused by the stretching process in which polymer crystals at the surface (and interior parts) of the fibers are generated which increase the surface roughness. Monofilaments generated according to embodiments of the invention have a higher surface roughness than e.g. polymer fibers generated by slitting polymer films into thin stripes, because the cutting of polymer films destroys the crystalline structures at the areas having contacted the blade of the cutting knife.

FIG. 6 shows a schematic drawing of a cross-section of a multi-phase polymer mixture 400. The polymer mixture 400 comprises at least a first phase 404 and a second phase 402. The first phase comprises a first dye and an LDPE-LLDPE polymer mixture according to embodiments of the invention as shown, for example, in FIG. 4. The second phase 402 comprises an additional polymer that is immiscible with the polymers in the first phase and a second dye. For example, the additional polymer may be PA which may provide for an improved resilience of the fibers. In the depicted embodiment, the polymer mixture comprises a third phase 406 that mainly or solely comprises a compatibilizer. The third phase may comprise the first or the second or a third dye or no dye at all. The first phase and the second phase are immiscible. The additional polymer and the second phase 402 are less abundant than the first phase (that mainly consists of the LLDPE-LDPE mixture). The second phase 402 is shown as being surrounded by the compatibilizer phase 406 and being dispersed within the first phase 404. The second phase 402 surrounded by the compatibilizer phase 406 forms a number of polymer beads 408. The polymer beads 408 may be spherical or oval in shape or they may also be irregularly-shaped depending up on how well the polymer mixture is mixed and the temperature. The polymer mixture 400 is an example of a three-phase system. The compatibilizer phase 406 separates the first phase 402 from the second phase 406. The additional polymer may be stiffer and more resilient than the polymers in the first phase, thereby increasing stiffness and resilience of the fiber Due to flow conditions during extrusion, the beads are formed into thread-like regions that are predominantly located in the interior parts of the monofilament. This particular location is advantageous as the increased stiffness of the threadlike regions (relative to the surrounding first polymer phase) may increase the risk of skin burns in case a person slides with his skin across a section of artificial turf if the threadlike regions would predominantly lie on the surface of a fiber.

In the context of manufacturing fibers comprising thread-like-regions of the additional polymer (that is preferentially more rigid than the polymers in the first phase), increasing the resistance to splicing in the first phase is particularly advantageous, as it prevents the rigid, thread-like regions (mainly located inside a fiber) being exposed to the surface due to delamination or other forms of splicing.

Figure 7:
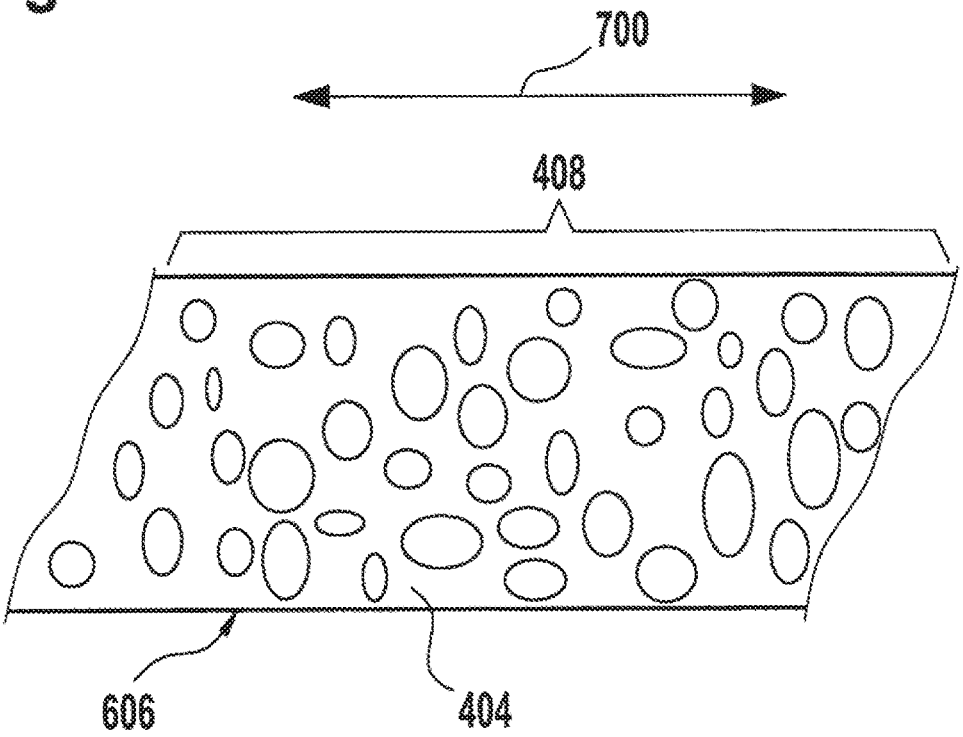
FIG. 7 shows a cross-section of a small segment of the monofilament.

FIG. 7 shows a cross-section of a small segment of the monofilament 606. The monofilament is again shown as comprising the first phase 404 comprising the LLDPE-LDPE polymer mixture according to embodiments of the invention that may—as the case here—optionally comprise a second phase in the form of polymer beads 408 mixed in. The polymer beads 408 are separated from the second polymer by compatibilizer which is not shown. To form the thread-like structures a section of the monofilament 606 is heated and then stretched along the length of the monofilament 606. This is illustrated by the arrows 700 which show the direction of the stretching. The first and second polymer phases may comprise dies having different colors.

Figure 8:
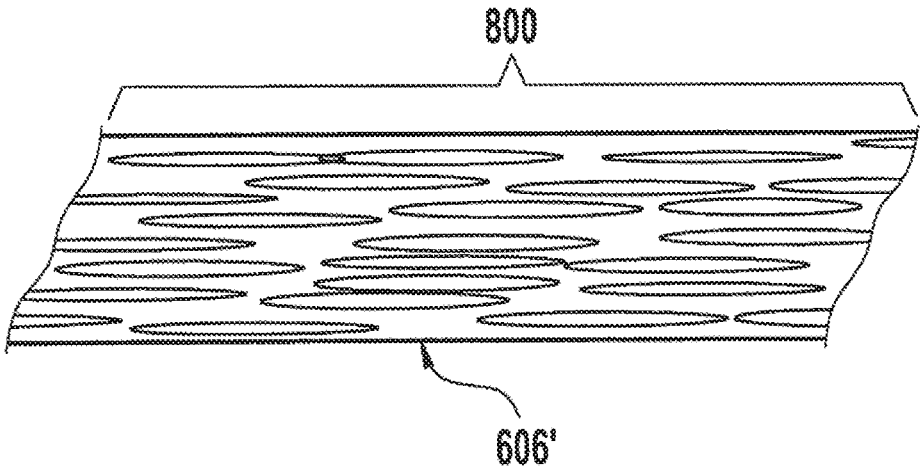
FIG. 8 illustrates the effect of stretching the monofilament.

FIG. 8 illustrates the effect of stretching the monofilament 606. In FIG. 8 an example of a cross-section of a stretched monofilament 606 is shown. The polymer beads 408 in FIG. 7 have been stretched into thread-like structures 800. The amount of deformation of the polymer beads 408 would be dependent upon how much the monofilament 606' has been stretched.

Examples may relate to the production of artificial turf which is also referred to as synthetic turf. In particular, the invention relates to the production of fibers that imitate grass both in respect to mechanical properties (flexibility, surface friction) as well as optical properties (color texture). The fibers according to the depicted embodiment are composed of first and second phases that are not miscible and differ in material characteristics as e.g. stiffness, density, polarity and in optical characteristics due to the two different dyes. In some embodiments, a fiber may in addition comprise a compatibilizer and further components. In other embodiments, the polymer mixture consists of only one liquid phase comprising one or more LLDPE polymers, one or more LDPE polymers and optionally one or more additives.

In a first step, the polymer mixture is generated comprising at least one LLDPE and one LDPE polymer in a particular density range corresponding to a particular tacticity and branching pattern.

In embodiments where the polymer mixture further comprises an additional polymer that forms a second phase, the quantity of the second phase may be 5% to 10% by mass of the polymer mixture and the quantity of an optional third phase being largely or completely comprised of the compatibilizers being 5% to 10% by mass of the polymer mixture. The amount of the LLDPE polymer in the first phase is adapted accordingly. Using extrusion technology results in a mixture of droplets or of beads of the second phase surrounded by the compatibilizer, the beads being dispersed in the polymer matrix of the first polymer phase and having a different color than the second phase.

The melt temperature used during extrusion is dependent upon the type of polymers and compatibilizer that is used. However the melt temperature is typically between 230° C. and 280° C.

A monofilament, which can also be referred to as a filament or fibrillated tape, is produced by feeding the mixture into an fiber producing extrusion line. The melt mixture is passing the extrusion tool, i.e., a spinneret plate or a wide slot nozzle, forming the melt flow into a filament or tape form, is quenched or cooled in a water spin bath, dried and stretched by passing rotating heated godets with different rotational speed and/or a heating oven.

The monofilament or type is then annealed online in a second step passing a further heating oven and/or set of heated godets.

By this procedure the beads or droplets (optionally surrounded by a compatibilizer phase) are stretched into longitudinal direction and form small fiber like, linear structures, also referred to as thread-like regions. The majority of the linear structures is completely embedded into the LLDPE-LDPE-polymer matrix 404 but a significant portion of the linear structures is also at the surface of the monofilament.

The resultant fiber may have multiple advantages, namely softness combined with durability and long term elasticity and tensile strength in combination with resistance to splicing. The large amount of LLDPE polymer will ensure a high tensile strength while the LDPE polymer added in the specified LDPE/LLDPE ratio will promote chain entanglement and thus protect the fiber from splicing. In case of different stiffness and bending properties of the polymer phases, the fiber can show a better resilience (this means that once a fiber is stepped down it will spring back). In case of a stiff additional polymer 402, the small linear fiber structures built in the polymer matrix are providing a polymer reinforcement of the fiber.

Delimitation due to the composite formed by the polymers in the first and second phases is prevented due to the fact that the thread-like regions of the additional polymer are embedded in the matrix given by the LLDPE-LDPE polymer phase 404.

Figure 9:
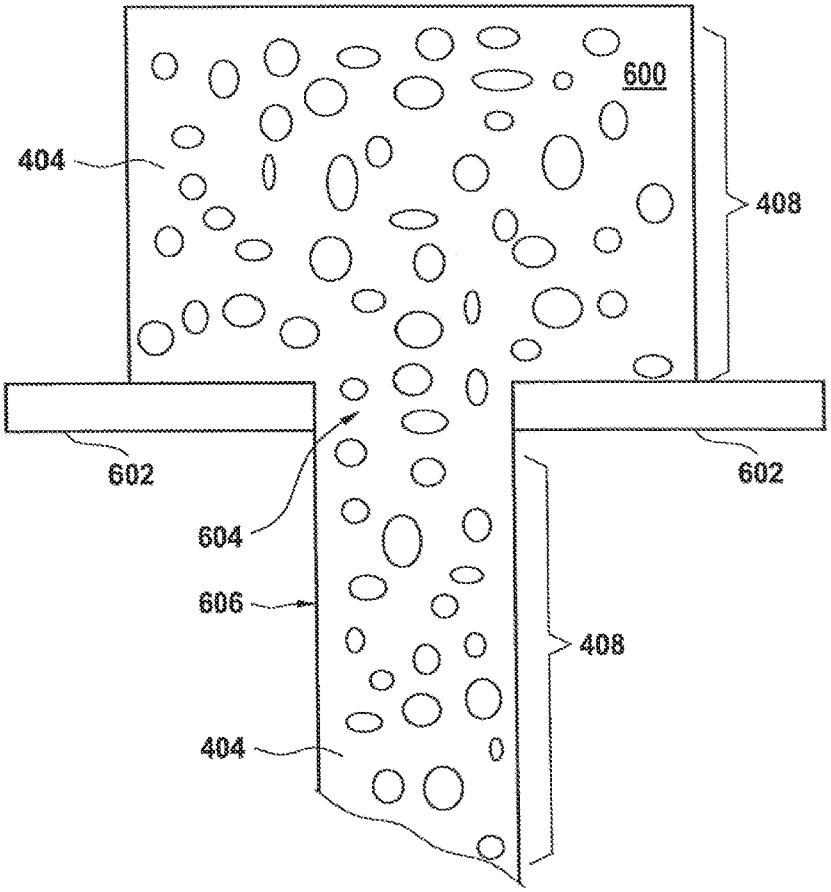
FIG. 9 illustrates the extrusion of the polymer mixture into a monofilament.

FIG. 9 illustrates the extrusion of the polymer mixture into a monofilament. Shown is an amount of polymer mixture 600. Within the polymer mixture 600 there is a large number of polymer beads 408. The polymer beads 408 may be made of one or more polymers that are not miscible with the LLDPE-LDPE polymer mixture in the first phase 404 and are separated from the first phase by a compatibilizer. A screw, piston or other device is used to force the polymer mixture 600 through a hole 604 in a plate 602. This causes the polymer mixture 600 to be extruded into a monofilament 606. The monofilament 606 is shown as containing polymer beads 408 also. The polymers in the first phase 404 and the polymer beads 408 are extruded together. In some examples the first phase will be less viscous than the polymer beads 408 comprising the additional polymer, e.g. PA, and the polymer beads 408 will tend to concentrate in the center of the monofilament 606. This may lead to desirable properties for the final artificial turf fiber as this may lead to a concentration of the thread-like regions in the core region of the monofilament 606. However, the composition of the first and second phases and in particular the polymers contained therein are chosen such (e.g. in respect to polymer chain length, number and type of side chains, etc.) that the first phase has a higher viscosity than the second phase and that the beads and the thread-like regions concentrate in the core region in the monofilament. In embodiments where the two different phases comprise dyes of different colors, the additional polymer is chosen such that its viscosity properties in combination with the viscosity properties of the polymers in the first phase ensures that there are still sufficient amounts of the beads and the thread-like regions on the surface of the monofilament to result in a marbled color texture on the surface of the monofilament.

Figure 10:
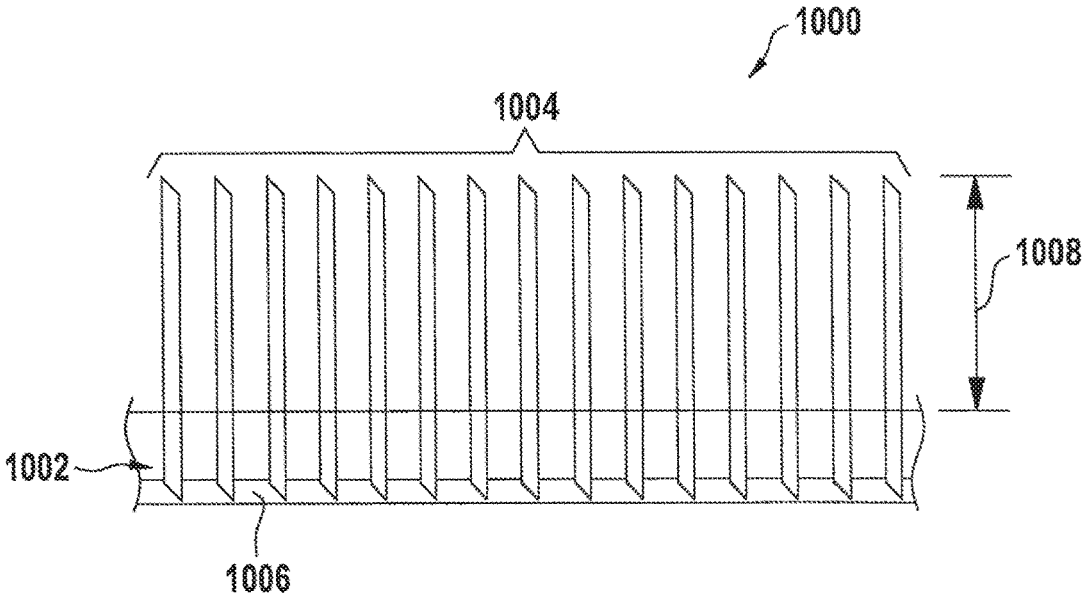
FIG. 10 shows an example of a cross-section of an example of artificial turf.

FIG. 10 shows an example of a cross-section of an example of artificial turf 1000. The artificial turf 1000 comprises an artificial turf backing 1002. Artificial turf fiber 1004 has been tufted into the artificial turf backing 1002. On the bottom of the artificial turf backing 1002 is shown a coating 1006. The coating may serve to bind or secure the artificial turf fiber 1004 to the artificial turf backing 1002. The coating 1006 may be optional. For example the artificial turf fibers 1004 may be alternatively woven into the artificial turf backing 1002. Various types of glues, coatings or adhesives could be used for the coating 1006. The artificial turf fibers 1004 are shown as extending a distance 1008 above the artificial turf backing 1002. The distance 1008 is essentially the height of the pile of the artificial turf fibers 1004. The length of the thread-like regions within the artificial turf fibers 1004 is half of the distance 1008 or less. The coating may, for example, be a PU or latex film that is applied as a liquid film on the bottom side of the turf backing, that surrounds portions of the fibers at least partially, and that solidifies and thereby mechanically fixes the polymer fibers in the backing.

LIST OF REFERENCE NUMERALS

102 LDPE molecule
104 LLDPE molecule
302-306 regions having different shear forces during extrusion
308 crystalline polymer portions

310 opening of extrusion nozzle
400 polymer mixture
402 second phase
404 first phase
406 third phase with compatibilizer
408 polymer bead
450 first LLDPE polymer
452 "master batch" LLDPE polymer (with additives)
454 LDPE polymer
456 second ("low density") LLDPE polymer
470 polymer mixture
502-510 steps
600 polymer mixture
602 plate
604 hole
606 monofilament
606' stretched monofilament
1000 artificial turf
1002 artificial turf carpet
1004 artificial turf fiber (pile)
1006 coating
1008 height of pile

The invention claimed is:

1. A method of manufacturing an artificial turf fiber, the method comprising:

creating a polymer mixture comprising, a first linear low-density polyethylene (LLDPE) polymer in an amount of 60-99% by weight of the polymer mixture, the LLDPE polymer having a density in a range of 0.918 g/cm$^3$ to 0.920 g/cm$^3$;

a second LLDPE polymer in an amount of 7-13% by weight of the polymer mixture, the second LLDPE polymer having a density in a range of 0.914 g/cm$^3$ to 0.918 g/cm$^3$;

a low-density polyethylene (LDPE) polymer in an amount of 1-15% by weight of the polymer mixture, the LDPE polymer having a density in a range of 0.919 g/cm$^3$ to 0.921 g/cm$^3$;

extruding the polymer mixture into a monofilament;

quenching the monofilament;

reheating the monofilament;

stretching the reheated monofilament to form the monofilament into the artificial turf fiber.

2. The method of claim 1, the polymer mixture comprising:

the LDPE polymer in an amount of 5-8% by weight of the polymer mixture, the first LLDPE polymer in an amount of 60%-95% by weight of the polymer mixture, or both.

3. The method of claim 1, the polymer mixture comprising one or more additives selected from a group comprising: a wax, a dulling agent, an ultraviolet (UV) stabilizer, a flame retardant, an anti-oxidant, a pigment, a filling material, or any combination thereof.

4. The method of claim 1, wherein the first LLDPE polymer is a polymer created by a polymerization reaction under the presence of a Ziegler-Natta catalyst.

5. The method of claim 1, wherein the first LLDPE polymer is a polymer created by a polymerization reaction under the presence of a metallocene catalyst.

6. The method of claim 1, wherein the first LLDPE polymer is a polymer created by copolymerizing ethylene with 5-12% α-olefins having 3-8 carbon atoms.

7. The method of claim 1, wherein the first LLDPE polymer comprises 0.001-10 tertiary C-atoms per 100 C atoms of the polymer chain.

8. The method of claim 1, wherein manufacturing the artificial turf fiber comprises forming the stretched monofilament into a yarn.

9. The method of claim 1, further comprising spinning, twisting, rewinding, and/or bundling the stretched monofilament into the artificial turf fiber.

10. The method of claim 1, the polymer mixture being at least a two-phase system, a first one of the phases comprising a first dye and the components of the polymer mixture, the second phase comprising a second dye and an additional polymer that is immiscible with the first phase, the second dye having a different color than the first dye, the additional polymer forming polymer beads within the first phase.

11. The method of claim 10, wherein the additional polymer is a polar polymer and/or is any one of the following: polyamide, polyethylene terephthalate (PET), and polybutylene terephthalate (PBT).

12. An artificial turf fiber manufactured according to the method of claim 1.

13. A method of manufacturing an artificial turf, comprising:

manufacturing the artificial turf fiber according to the method of claim 1; and incorporating the artificial turf fiber into an artificial turf backing.

14. The method of claim 13, wherein incorporating the artificial turf fiber into the artificial turf backing comprises: tufting the artificial turf fiber into the artificial turf backing and binding the artificial turf fibers to the artificial turf backing; or weaving the artificial turf fiber into the artificial turf backing.

15. An artificial turf manufactured according to the method of claim 13.

16. An artificial turf fiber comprising:

60-99% by weight of a first linear low-density polyethylene (LLDPE) polymer the LLDPE polymer having a density in a range of 0.918 g/cm$^3$ to 0.920 g/cm$^3$;

7-13% by weight a second LLDPE polymer, the second LLDPE polymer having a density in a range of 0.914 g/cm$^3$ to 0.918 g/cm; and 1-15% by weight of a low-density polyethylene (LDPE) polymer, the LDPE polymer having a density in a range of 0.919 g/cm$^3$ to 0.921 g/cm$^3$.

17. An artificial turf comprising an artificial turf textile backing and the artificial turf fiber according to claim 16, the artificial turf fiber being incorporated into the artificial turf backing.

18. The artificial turf of claim 17, wherein the monofilament is an extruded and stretched monofilament.

* * * * *